US007014540B2

(12) United States Patent
Nagel

(10) Patent No.: US 7,014,540 B2
(45) Date of Patent: Mar. 21, 2006

(54) DEVICE FOR THE PRECISION WORKING OF PLANAR SURFACES

(75) Inventor: Peter Nagel, Nuertingen (DE)

(73) Assignee: KADIA Produktion GmbH + Co., Nuertingen (DE)

( * ) Notice: Subject to any disclaimer, the term of this patent is extended or adjusted under 35 U.S.C. 154(b) by 0 days.

(21) Appl. No.: 10/842,049

(22) Filed: May 7, 2004

(65) Prior Publication Data

US 2005/0020198 A1 Jan. 27, 2005

(30) Foreign Application Priority Data

May 9, 2003 (DE) ..... 103 22 360

(51) Int. Cl.
*B24B 1/00* (2006.01)

(52) U.S. Cl. ..... 451/57; 451/65; 451/268

(58) Field of Classification Search ..... 451/548, 451/273, 270, 271, 272, 63, 259, 258, 57, 451/59, 65

See application file for complete search history.

(56) References Cited

U.S. PATENT DOCUMENTS

| | | | | |
|---|---|---|---|---|
| 3,634,973 | A * | 1/1972 | McCarty | 451/36 |
| 3,885,925 | A * | 5/1975 | Tatar | 451/48 |
| 4,044,508 | A * | 8/1977 | Frederick | 451/27 |
| 4,811,521 | A * | 3/1989 | Nakae et al. | 451/72 |
| 6,179,695 | B1 | 1/2001 | Takahashi et al. | |
| 6,277,002 | B1 * | 8/2001 | Leadbeater | 451/57 |
| 6,336,849 | B1 | 1/2002 | Könnemann | |
| 6,428,393 | B1 * | 8/2002 | Yukawa et al. | 451/41 |
| 2003/0049997 | A1 | 3/2003 | Jeong | |

FOREIGN PATENT DOCUMENTS

| | | |
|---|---|---|
| DE | 1652135 B | 7/1971 |
| DE | 4208615 C1 | 8/1993 |
| DE | 20208944 U1 | 10/2002 |
| WO | WO 99/39873 | 8/1999 |
| WO | WO 03/022518 A2 | 3/2003 |

OTHER PUBLICATIONS

German Search Report dated Oct. 16, 2003 for Application No. 103 22 360.6 (3 pages).
European Patent Office Search Report dated Nov. 7, 2005 (3 pages).

* cited by examiner

*Primary Examiner*—Dung Van Nguyen
(74) *Attorney, Agent, or Firm*—Flynn, Thiel, Boutell & Tanis, P.C.

(57) ABSTRACT

A device for the precision working of planar surfaces, in particular for the plane finishing, has a tool (13), which has an outer and an inner operating surface (36, 44). These are designed like cup wheels, which fit into one another, and are rotatable together, however, can be axially fed independent of one another. This is done with respect to the outer operating surface (36) by means of the spindle drive of a honing machine, which is preferably designed as a linear motor, whereas the inner operating surface (44) is fed through the feed drive (28) of the honing machine, which feed drive extends inside of the spindle and of the tool.

9 Claims, 2 Drawing Sheets

11
25
26
27
62
12
22
20
24
19
21
13
54
14
28
23
22
61
60
58
55
18
57
16
56
17
15

DEVICE FOR THE PRECISION WORKING OF PLANAR SURFACES

FIELD OF APPLICATION AND STATE OF THE ART

The invention relates to a device for the precision working of planar surfaces on workpieces, in particular for plane finishing.

Plane surfaces are finished by dry or wet grinding with grinding wheels rotating at a high speed. Precision finishing to meet greater demands regarding evenness of the planar surface is made possible by rotating honing sleeves (cup wheels), which due to their higher degree of coverage enable the desired preciseness in form.

The DE 202 08 944.4 U of the Applicant describes a machine for the precision working through honing, where also a tool with a conical grinding head for the working of valve seats is shown.

PURPOSE AND SOLUTION

The purpose of the invention is to improve a device for the precision working of planar surfaces so that it can be used more universally and enables a working up to a high surface quality.

This purpose is attained by the device housing at least two operating surfaces covered with cutting means on the face side, which operating surfaces are axially movable independent of one another, however, rotate together about a tool axis.

These operating surfaces, which are preferably arranged concentrically to one another, can be designed like cup wheels, which lie in one another and have varying layers of cutting means. Thus it is for example possible for the outer operating surface to have for the pre-working a coarser and the inner operating surface for the finish working a finer granulation of cutting means.

The tool can be connected to a tool spindle and can be axially movable by an axial spindle drive. Same can be formed by an electric linear motor, which can be precisely regulated so that this axial movement is the feed of the outer operating surface, namely of the cup wheel lying on the outside. The cup wheel lying on the inside can be adjusted by a feed rod extending through the drive spindle of the tool.

Particularly preferred is a device of the above-mentioned type which is designed as a honing machine with a tool spindle rotatable about a spindle axis, on which tool spindle a tool of the afore-described type can be mounted so that the device has a rotary drive for the tool, an axial spindle drive for the tool spindle, for example for the advance of the outer cup wheel, and an axial feed drive embedded in the tool spindle, which feed drive can feed the inner cup wheel.

Furthermore a rotary drive for the workpiece is thereby provided, which rotary drive has a workpiece rotary axis eccentric with respect to the spindle axis. This can be a separate device, which is built on the workpiece table of the honing machine and is integrated into same.

The device operates preferably with annular operating surfaces with a relatively small annular width in comparison to the annular diameter.

The cutting speed, which results from a superpositioning of the peripheral speeds of the respective operating surface and of the workpiece, lies preferably between 10 m/min and 50 m/min. As a comparison: The cutting speed during grinding lies at 30 m/s.

Work is done with low contact pressures, for example, with 10–100 N/cm$^2$, even though it is possible that the axial drives, which cause the feed, are displacement-controlled, which takes care of a good dimensional accuracy.

The layers of cutting means contain mostly high-quality cutting granules, like diamond or boron nitrite, with a granulation of below 15 $\mu$m, preferably at 10 $\mu$m, which, however, varies depending on whether pre-finishing or fine finishing is supposed to take place. However, also ceramically bonded cup wheels with precious corundum cutting granules or silicon cutting granules with the granule size of 300–1000 mesh/inch sieve size (mesh) are utilized. They are particularly porous and self-sharpening.

The intended material removal for the pre-finishing is in most cases 20 $\mu$m to 30 $\mu$m, whereas only 1 $\mu$m to 3 $\mu$m are removed during the fine finishing.

These and further characteristics of preferred embodiments of the invention can be taken aside from the claims also from the description and the drawings. The individual characteristics can thereby be realized each by itself alone or several together in the form of sub-combinations in an embodiment of the invention and in other fields, and can represent advantageous and by itself protectable embodiments, for which protection is claimed here. Exemplary embodiments of the invention are illustrated in the drawings and are discussed in greater detail hereinafter.

DETAILED DESCRIPTION OF PREFERRED EXEMPLARY EMBODIMENTS

Figure 1:
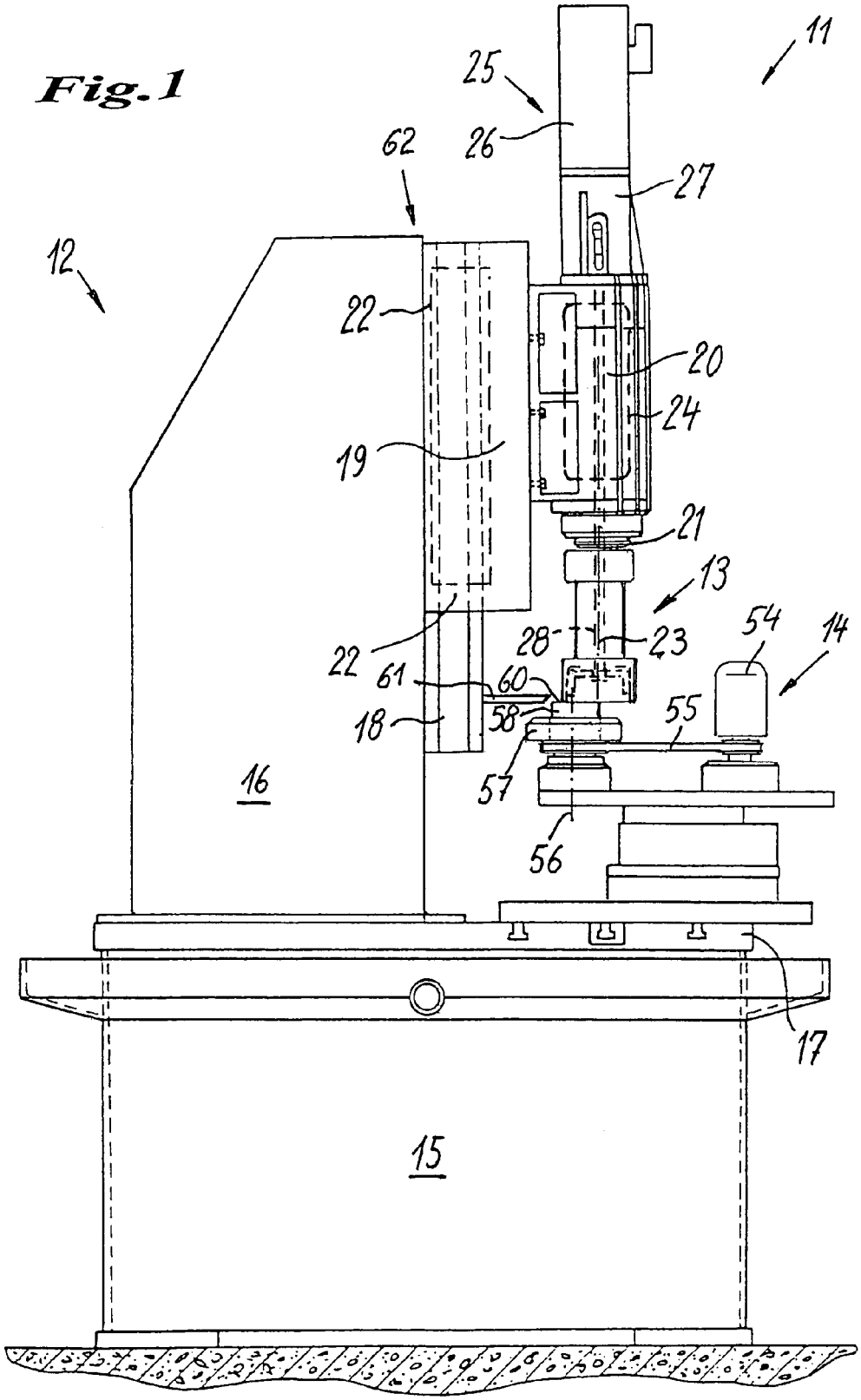
FIG. 1 is a side view of a device according to the invention housing a honing machine.

FIG. 1 illustrates a device 11, which consists of a honing machine 12 or a special machine built similar to a honing machine, a tool 13 and a workpiece rotary drive 14. The honing machine has a base 15, a machine column and a workpiece clamping table 17 on the base.

A vertical guide 18 for a spindle carriage 19 is provided on the column 16, which spindle carriage carries the spindle box 20 of a vertical main spindle 21.

The spindle carriage 19 and the associated spindle guide 18 house the primary and secondary parts of an electric linear motor. This linear motor 22, which is not illustrated in detail in the drawings, the guide 18 and the spindle carriage 19 are described and illustrated in detail in DE 202 08 944.4 U, which is incorporated herein by reference.

The spindle box 20 supports the spindle 21, which is rotatable about the vertical tool axis of rotation 23 and houses an electric drive motor (indicated by dashes in FIG. 1), which forms the rotary drive 24 for the workpiece about the axis 23. This rotary drive and, if necessary, also the linear motor can be frequency-controlled synchronous motors, the control of which occurs through frequency conversion.

Figure 2:
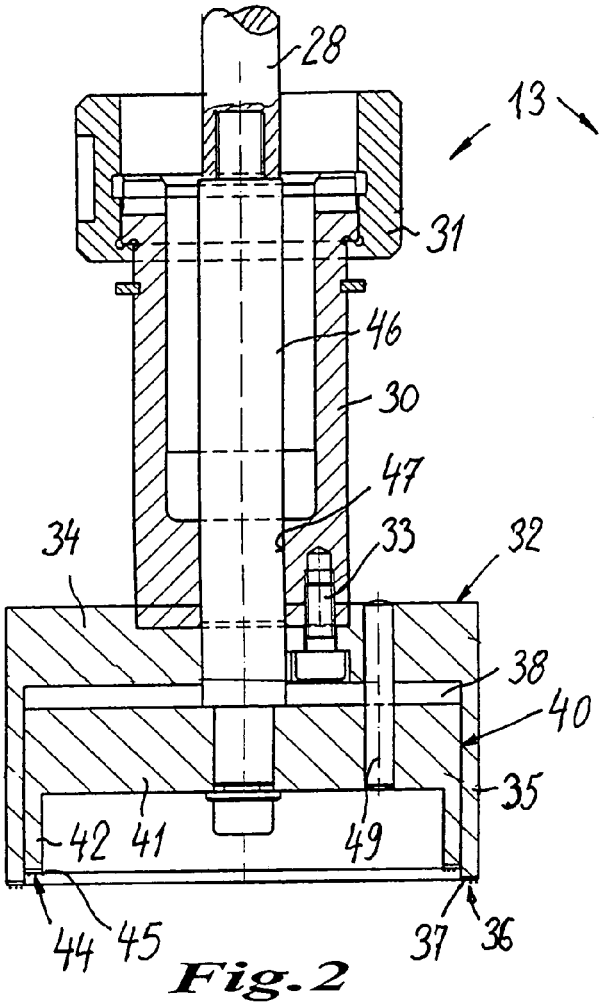
FIGS. 2 and 3 are longitudinal cross-sectional views of two different versions of a tool.
Figure 3:
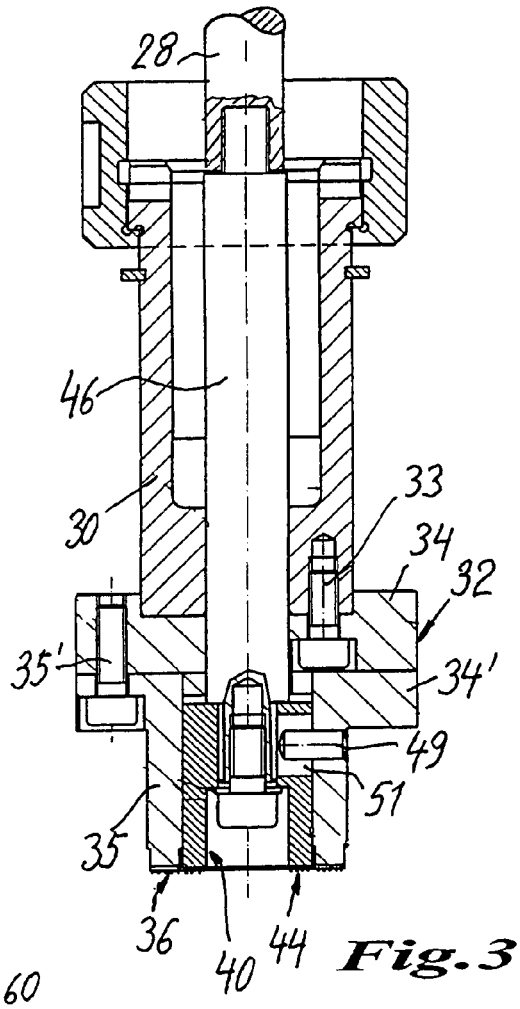

A feed drive 25 is flanged onto the spindle box 20, which feed drive has an electric stepping motor 26 and a rotary/linear converter 27, which converts the rotary drive of the stepping motor 26 into an axial movement of a feed rod 28 (see FIGS. 2 and 3). As a rule this is a gearing with a threaded spindle and threaded nut, which converts the rotation of the motor into precise axial movements. It is here also possible to use ball roller spindles, etc.

The tool 13 is coupled to a tool coupling of the spindle, for example, like a bayonet lock. The embodiment illustrated in FIG. 2 has a base member 30, at one end of which is arranged a connecting ring 31 for the coupling with the spindle. At the other end, in the drawing the lower end of the base member, there is mounted an outer tool part 32 by means of screws 33. It has the shape of a cup wheel with a disk-shaped base 34 and a relatively narrow outer wall 35, which projects toward the free end of the tool.

The lower face of the wall 35 forms the outer operating surface 36 of the tool. It has a layer of cutting means 37. It can consist of diamond or boron nitrite particles in a metallic or other bond, or can consist of corundum or other grinding means applied as a layer, as a separate annular stone, or in segment form.

A second cup-shaped inner tool part 40 is arranged in the space 38, which is created inside of the cup-shaped tool part 32. Inner tool part 40 also has a base 41 and a wall 42. Its outside dimensions are such that it is guided slidingly with a precise fit in the outer tool part 32, that is, on the inner surface of the wall 35. For a more precise guiding it is here also possible to provide special bearing surfaces (not illustrated), which can also be adjustably designed. The axial length of the inner tool part is shorter than the axial depth of the space 38 so that the inner tool part 40 can be completely retracted into said space 38.

The lower face of the wall 42 of the inner tool part 40 forms the inner operating surface 44 of the tool. It also has a layer of cutting means 45, which has principally the same design as the layer 37, however, in most cases it has a significantly smaller granulation than the layer 37. The inner tool part 40 is fixedly connected to a center feed rod 46, which is guided in a bore 47 of the base member 30 and of the outer tool part 32. The feed rod 46 is fixedly connected, for example, by screws to the feed rod 28, which extends inside of the tool spindle 21, so that it transfers the movement of the feed rod 28 precisely onto the inner tool part 40 and can thus move it relative to the outer tool part 32. The two tool parts 32, 40 are indeed axially movable to one another, however, they are connected to one another in the direction of rotation, namely by a guide pin 49 engaging both base parts 34, 41. It is here also possible to provide a groove/spring guide or the like.

The tool illustrated in FIG. 3 is identical to the one according to FIG. 2 with the exception of the characteristics described hereinafter, reference is therefore made to its description. The base 34 of the outer tool part 32 is designed as a disk, to which is screwed from the face side a flange 34' provided on the wall 35 by means of screws 33'. The wall 35 has in FIG. 3 a significantly smaller annular diameter d, however, a larger annular width a than the one in FIG. 2. The operating surface 36 is accordingly also wider, however, takes up an annular surface, which is smaller in diameter. The same is true for the inner tool part 40, which is fixed against rotation by a radially extending guide pin 49, which is guided in a slotted hole or a slit 51 of the inner tool part.

FIG. 1 shows furthermore that the rotary drive of the workpiece 14 is arranged on the clamping table. An electric motor 54 is arranged on a base which houses, if necessary, a cross-table for positioning of the workpiece, which electric motor drives a chuck 57 for the workpiece 58 to be machined, which chuck is rotatable about an axis of rotation of the workpiece 56, if desired, through an intermediate gearing and a belt drive 55. The workpiece has an upper planar surface 60, which is to be worked. It is also possible to give the workpiece, for example, through an additional oscillation drive, an oscillating motion superimposed upon or replacing the rotary motion.

A cooling lubricant feed 61 integrated into the machine is directed with its port onto the surface 60 to be worked.

OPERATION

Figure 4:
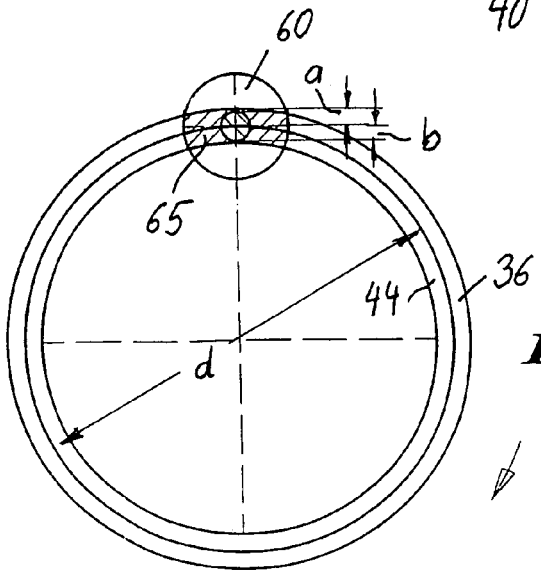
FIG. 4 is a schematic illustration of the operating paths of the tool according to FIG. 2.

The tool 13 has the purpose to first pre-finish and then finish the workpiece surface 60 to be worked. The tool is for this purpose fed in a position corresponding approximately to FIG. 2, that is, with a downwardly projecting outer operating surface 36, by means of the axial spindle drive 62, which includes the linear motor 22, onto the workpiece, first rapidly, and then with a finely controlled feed. This is possible directly and extraordinarily sensitively by means of the linear motor, whereby suitable sensors can define the feed. The feed of the outer operating surface thus takes place through the spindle system. The tool and the workpiece are thereafter each driven oppositely directed so that a resulting operating speed in the magnitude of between 10 m/min and 50 m/min results. The coverage illustrated in FIG. 4 is then created with a tool corresponding to FIG. 2, whereby the outer large ring represents the operating surface 36 and the inner ring the operating surface 44. These relatively narrow operating surfaces, with annular width a and b respectively, only cover approximately between ⅙ (as in the case of the tool according to FIG. 3) and 1/50 of the annular diameter d, and work in either case only one arched strip 65 of the workpiece surface 60. However, the entire workpiece surface is covered by the oppositely directed rotation of workpiece and tool. The peg (axis of rotation 56) would in this case remain outside of the outer operating surface. In the case that the workpiece has a peg (axis of rotation 56) in the center of the surface to be worked, thus only one annular surface is to be worked, this is also possible and is made easier by the relatively narrow operating surfaces.

The feed that occurs position-dependently through the linear motor could, however, also be controlled force-dependently. This preferably occurs continuously, however, in steps until the desired dimension is reached. The work is done wet, that is, with the addition of a cooling lubricating liquid, for example, honing oil or suitable emulsions from the feed 61.

The outer tool part 32 is thereafter together with the entire spindle system slightly moved back with rapid power in order to disengage the outer operating surface 36 from the workpiece surface 60. Thereafter, the inner tool part 40 is fed by operating the stepping motor 26 with rapid power until the inner operating surface 44, the fine finishing surface, engages the workpiece surface 60. The feed occurs accordingly with significantly smaller steps, which is transferred by a servomotor through the rotary/linear converter 27 onto the feed rods 28, 46, and is thus transferred mechanically directly onto the inner operating surface 44. By feeding in small feeding steps, there occurs now the fine finishing until the desired dimension and surface quality has been reached. It is also possible to utilize a minimum flexibility of the linear motor during feeding and/or axial blocking for the cutting pressure averaging. If necessary, it would also be possible to adjust the rotary speed of tool and workpiece between pre-finishing and fine finishing. The feed drive is thereby blocked. This can be done electrically through the linear motor and/or mechanically.

The operation of the tool according to FIG. 3 is identical with the exception that the annular width of the operating surfaces is there greater than the annular widths a and b in FIG. 2, in particular taking into consideration the diameter d, which is smaller in FIG. 3 (compare FIG. 4).

A tool is created with the invention, with which pre-finishing and fine finishing can take place in one setting directly one after the other. However, it is also possible to carry out different operations one after the other or, for example, instead of a pulling back of the respective one operating surface, to permit both operating surfaces to operate simultaneously (in one part of the operation). The tool is designed to be simple and robust and can be inserted into different machines.

However, a particular advantage is that a normal honing machine, preferably one with a linear drive, however, also with other types of drives, can be utilized for the plane finishing. When, for example, a honing machine with a hydraulic axial spindle drive is used, then it would be possible for the pre-finishing to occur by feeding through this drive. In order to achieve the fine finishing, the axial spindle drive could then be blocked hydraulically, however mechanical blocking is preferable. The possibilities for use of a honing machine are broadened, which enables a flexible utilization of machinery with the use of a simply designed tool.

What is claimed is:

1. A device for the precision plane finishing of planar surfaces on workpieces, configured as a honing machine with a tool spindle rotatable about a spindle axis, on which a tool with at least one operating surface on the face side covered with cutting medium is mounted, whereby the device has a spindle rotary drive for the tool, an axial spindle drive for the tool spindle, and an axial feed drive embedded in the tool spindle, whereby furthermore a workpiece rotary drive is provided for the workpiece, which rotary drive has a workpiece axis of rotation eccentric with respect to the spindle axis, and whereby the feed occurs at least through one of the axial drives of the honing machine, the tool having at least two operating surfaces, which are covered on the face side with cutting means, and which are axially movable independent of one another, however, are together rotatable about the spindle axis, the operating surfaces having at least one inner and one outer operating surface viewed in radial direction, which operating surfaces are arranged concentrically to one another having varying cutting means surfaces, the spindle rotary drive and the workpiece rotary drive are controllable such that the cutting speed, which results from the superpositioning of the peripheral speeds of the respective operating surface and of the workpiece, is between 10 m/min and 50 m/min.

2. The device according to claim 1, wherein the workpiece rotary drive is oppositely directed to the spindle rotary drive.

3. The device according to claim 1, wherein the axial drives operate with path-controlled feed.

4. The device according to claim 1, wherein an inner operating surface can be fed by an axial feed drive relative to the tool spindle and to the outer operating surface by means of a feed rod driven by an electric stepping motor through a rotary/linear converter.

5. The device according to claim 1, wherein the operating surfaces are provided on tool parts, which are constructed like cup wheels, and which are arranged surrounding one another.

6. The device according to claim 1, wherein the tool, being connected to the tool spindle, can be axially moved by the axial spindle drive, which houses a linear motor, and this axial movement is the feed of an outer operating surface.

7. The device according to claim 1, wherein the operating surfaces comprise outer and inner operating the outer operating surface having for preparation a coarser cutting medium granulation and the inner operating surface for finish working a finer cutting medium granulation.

8. The device according to claim 1, wherein a diameter of at least one of the operating surfaces is several times, larger than the diameter of the workpiece.

9. The device according to claim 1, wherein the operating surfaces have an annular shape and have an annular width which is between 1/6 and 1/50 of the annular diameter.

* * * * *